United States Patent [19]

Gordon et al.

[11] Patent Number: 4,757,975

[45] Date of Patent: Jul. 19, 1988

[54] LONG TRAVEL BEAM JACK

[76] Inventors: Wesley Gordon, P.O. Box 1504, St Thomas, V.I. 00801; George Spector, 233 Broadway RM 3815, New York, N.Y. 10007

[21] Appl. No.: 55,192

[22] Filed: May 28, 1987

[51] Int. Cl.[4] ..... B66F 3/00

[52] U.S. Cl. ..... 254/133 A; 254/387

[58] Field of Search ..... 254/387, 133 A, 134, 254/45–48, 4 R, 4 B, 4 C, 108, 426, DIG. 4; 269/158; 414/10, 11

[56] References Cited

U.S. PATENT DOCUMENTS 267,081 11/1882 Hoag et al. ..... 254/108

742,126 10/1903 McFerrin ..... 254/134

2,491,972 12/1949 Halote ..... 254/158

2,969,220 1/1961 Spencer ..... 254/4 C

FOREIGN PATENT DOCUMENTS 1533357 7/1968 France ..... 254/387

*Primary Examiner*—Robert C. Watson

[57] ABSTRACT

A jack for supporting a ceiling beam is provided and consists of a pair of vertical sliding support members operated by a winch mechanism with cable which allows one person to set the beam. The jack will lift heavy loads eliminating the need for a crane and more manpower. In a modification the winch handle can be operated by a foot lever on base of the jack.

1 Claim, 1 Drawing Sheet

LONG TRAVEL BEAM JACK

BACKGROUND OF THE INVENTION

The instant invention relates generally to hoists and more specifically it relates to a jack for supporting a ceiling beam.

Numerous hoists have been provided in prior art that are adapted to be used for lifting, positioning and installing panels and other building material. For example, U.S. Pat. Nos. 2,969,220; 3,930,645 and 4,600,348 all are illustrative of such prior art. While these units may be suitable for the particular purpose to which they address, they would not be as suitable for the purposes of the present invention as heretofore described.

SUMMARY OF THE INVENTION

A primary object of the present invention is to provide a jack for supporting a ceiling beam that will overcome the shortcomings of the prior art devices.

Another object is to provide a jack for supporting a ceiling beam that allows one person to set the beam and which the jack will lift heavy loads eliminating the need for a crane and more manpower.

An additional object is to provide a jack for supporting a ceiling beam in which the winch handle can be operated by a foot lever giving the person operating the jack more control over the jack.

A further object is to provide a jack for supporting a ceiling beam that is simple and easy to use.

A still further object is to provide a jack for supporting a ceiling beam that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
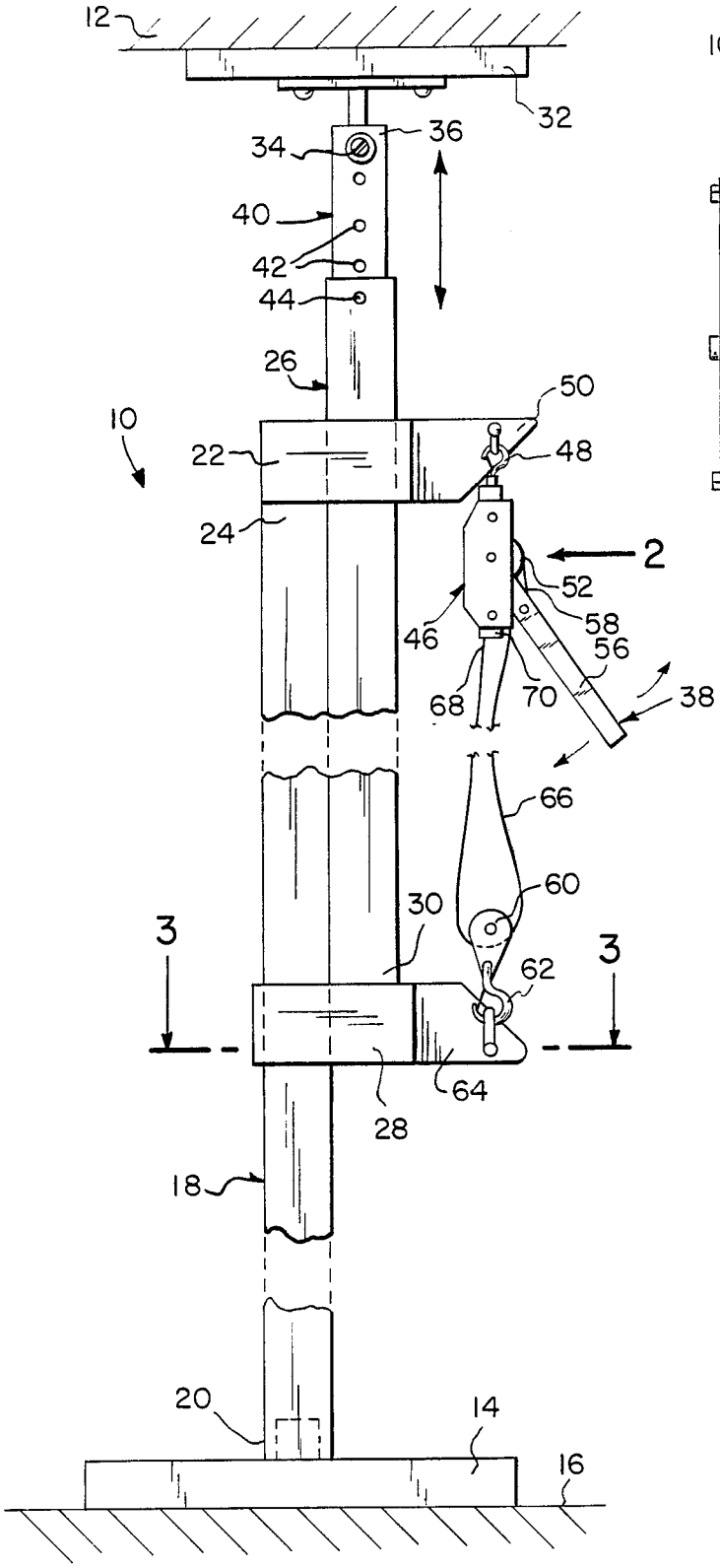
FIG. 1 is a side elevational view of the invention with parts broken away.
Figure 2:
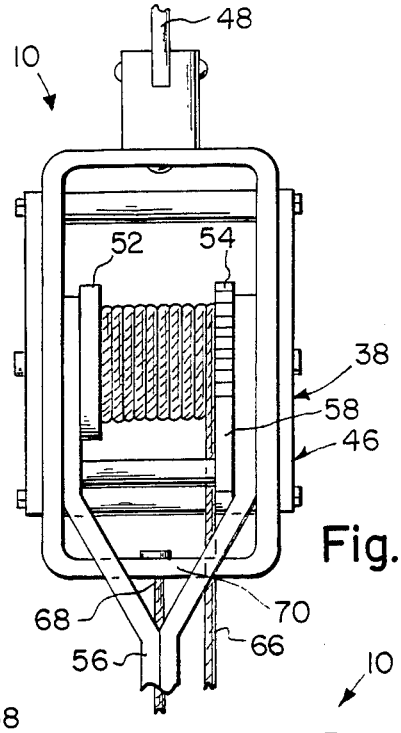
FIG. 2 is an enlarged front view of the winch mechanism in greater detail as indicated by arrow 2 in FIG. 1.
Figure 3:
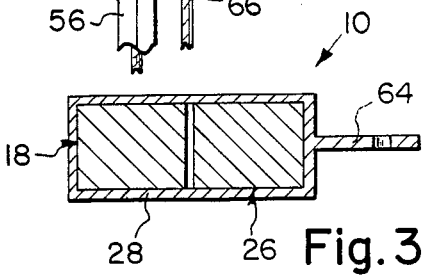
FIG. 3 is an enlarged cross sectional view taken along line 3—3 in FIG. 1 showing the lower track member in greater detail.

Turning now descriptively to the drawings, in which similar reference characters denote similar elements throughout the several views, FIGS. 1, 2 and 3 illustrate a jack 10 for supporting a ceiling beam 12 consisting of a base member 14 disposed upon a horizontal flat surface, such as a floor 16. A first support member 18 is retained at lower end 20 by the base member 14 in a vertical position. A first track member 22 is mounted transversely to upper end 24 of the first support member

18. A second support member 26 is provided with a second track member 28 mounted transversely to lower end 30 of the second support member 26. The second track member 28 can travel on the first support member 18 while the second support member 26 can travel within the first track member 22. A plate member 32 is for carrying the ceiling beam 12. The plate member is pivotly connected at 34 to upper end 36 of the second support member 26. A device 38 mounted between the first track member 22 and the second track member 28 along side of the second support member 26 for raising and lowering the second support member.

The second support member 26 further contains a telescoping adjustment portion 40 slideably extending upwardly therefrom, with the plate member 32 pivotly connected at 34 to the upper end 36 of the telescoping adjustment portion 40. The telescoping adjustment portion has a plurality of vertically spaced apart apertures 42 therethrough. A locking pin 44 extends through the second support member 26 and any of the apertures 42 in the telescoping adjustment portion 40 vary overall height of the jack 10.

The device 38 contains a winch mechanism 46 suspended downwardly by hook 48 from flange 50 of the first track member 22. The winch mechanism 46 includes a spool 52 that has a ratchet wheel 54 formed on one flange of the spool 52 and a pivotable arm 56 that has a pawl 58 engagable with the ratchet wheel 54 to turn the spool 52. A pulley 60 is suspended upwardly by hook 62 from flange 64 of the second track member 28. A cable 66 is attached at one end 68 to bottom 70 of the winch mechanism 46, extends around the pulley 60 and winded around the spool 52 of the winch mechanism for raising and lowering the second support member 26 when the winch mechanism 46 is manually activated by the pivotable arm 56 thereof.

Figure 4:
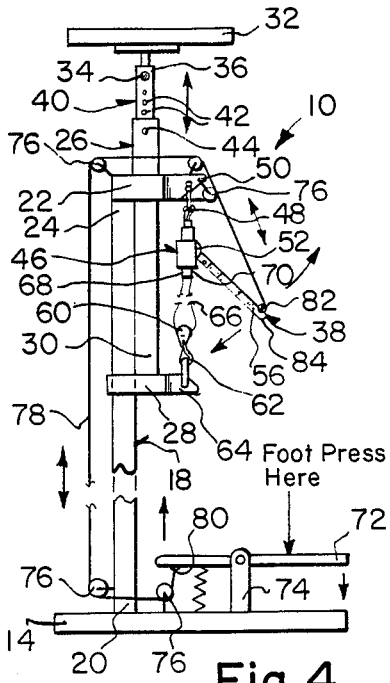
FIG. 4 is a side elevational view of a modification with parts broken away in which the winch handle is operated by a foot lever attached to an operating cable with rollers.

As shown in FIG. 4, the jack 10 can further contain a spring biased foot lever 72 mounted to the base member 14 at 74. A plurality of rollers 76 are spaced apart and each of which is rotatably affixed to the base member 14, side of the first support member 18 opposite from the second support member 26 and top of the first track member 22. An elongated second cable 78 is attached at one end 80 to the foot lever, extending past the rollers 76 with other end 82 attached to distal end 84 of the pivotable arm 56 of the winch mechanism 46 so that a person can operate the winch mechanism by foot control.

While certain novel features of this invention have been shown and described and are pointed out in the annexed claim, it will be understood that various omissions, substitutions and changes in the forms and details of the device illustrated and in its operation can be made by those skilled in the art without departing from the spirit of the invention.

What is claimed is:

1. A jack for supporting a ceiling beam which comprises:

(a) a base member disposed upon a horizontal flat surface;

(b) a first support member retained at lower end by said base member in a vertical position;

(c) a first track member mounted transversely to upper end of said first support member;

(d) a second support member;

(e) a second track member mounted transversely to lower end of said second support member whereby said second track member can travel on said first support member while said second support member can travel within said first track member;

(f) a plate member for carrying the ceiling beam, said plate member being pivotly connected to upper end of said second support member;

(g) means mounted between said first track member and said second track member along side of said second support member for raising and lowering said second support member;

(h) a telescoping adjustment portion slideably extending upwardly therefrom, with said plate member pivotly connected to the upper end of said telescoping adjustment portion, said telescoping adjustment portion having a plurality of vertically spaced apart apertures therethrough;

(i) a locking pin extending through said second support member and any of the apertures in said telescoping adjustment portion to vary overall height of said jack;

(j) a winch mechanism suspended downwardly from said first track member, said winch mechanism includes a spool having a ratchet wheel formed on one flange of the spool and a pivotable arm having a pawl engageable with the ratchet wheel to turn the spool;

(k) a pulley suspended upwardly from said second track member;

(l) a cable attached at one end to bottom of said winch mechanism, extending around said pulley and winded around the spool of said winch mechanism for raising and lowering said second support member when said winch mechanism is manually activated by the pivotable arm thereof;

(m) a spring biased foot lever mounted to said base member;

(n) a plurality of rollers spaced apart and each of which is rotatably affixed to said base member, side of said first support member opposite from said second support member and top of said first track member; and (o) an elongated second cable attached at one end to said foot lever, extending past said rollers with other end attached to distal end of the pivotable arm of said winch mechanism so that a person can operate said winch mechanism by foot control.

* * * * *